US011764471B1

(12) United States Patent
Ji et al.

(10) Patent No.: US 11,764,471 B1
(45) Date of Patent: Sep. 19, 2023

(54) ELEVATED FEED ANTENNA FOR WEARABLE ELECTRONIC DEVICES

(71) Applicant: Meta Platforms Technologies, LLC, Menlo Park, CA (US)

(72) Inventors: Zhong Ji, San Jose, CA (US); Ulf Jan-Ove Mattsson, Campbell, CA (US); Yonghua Wei, San Diego, CA (US); Md Rashidul Islam, Fremont, CA (US); Geng Ye, Union City, CA (US); Bruno Cendon Martin, Palo Alto, CA (US)

(73) Assignee: Meta Platforms Technologies, LLC, Menlo Park, CA (US)

( * ) Notice: Subject to any disclaimer, the term of this patent is extended or adjusted under 35 U.S.C. 154(b) by 0 days.

(21) Appl. No.: 17/834,612

(22) Filed: Jun. 7, 2022

(51) Int. Cl.
*H01Q 5/15* (2015.01)
*H01Q 5/35* (2015.01)

(52) U.S. Cl.
CPC ..... *H01Q 5/15* (2015.01); *H01Q 5/35* (2015.01)

(58) Field of Classification Search
CPC .. H01Q 5/15; H01Q 5/35; H01Q 1/42; H01Q 1/24; H01Q 1/241; H01Q 1/242; H01Q 1/243
See application file for complete search history.

(56) References Cited

U.S. PATENT DOCUMENTS

2020/0281467 A1* 9/2020 Biederman ..... H01Q 11/08

* cited by examiner

*Primary Examiner* — Hoang V Nguyen
(74) *Attorney, Agent, or Firm* — Greenberg Traurig, LLP

(57) ABSTRACT

The disclosed system may include a housing that includes a non-conducting substrate and a conductive enclosure that at least partially surrounds the non-conducting substrate. The system may also include an antenna disposed on the non-conducting substrate of the housing. Still further, the system may include a direct electrical connection between the antenna and a first portion of the conductive enclosure. Moreover, the system may include an antenna feed electrically connected to a separate conductive portion on the non-conducting substrate. The separate portion of the non-conducting substrate may be electrically connected to a second portion of the conductive enclosure. Various other apparatuses, wearable electronic devices, and methods of manufacturing are also disclosed.

20 Claims, 7 Drawing Sheets

ELEVATED FEED ANTENNA FOR WEARABLE ELECTRONIC DEVICES

BRIEF DESCRIPTION OF THE DRAWINGS

The accompanying drawings illustrate a number of exemplary embodiments and are a part of the specification. Together with the following description, these drawings demonstrate and explain various principles of the present disclosure.

Figure 1:
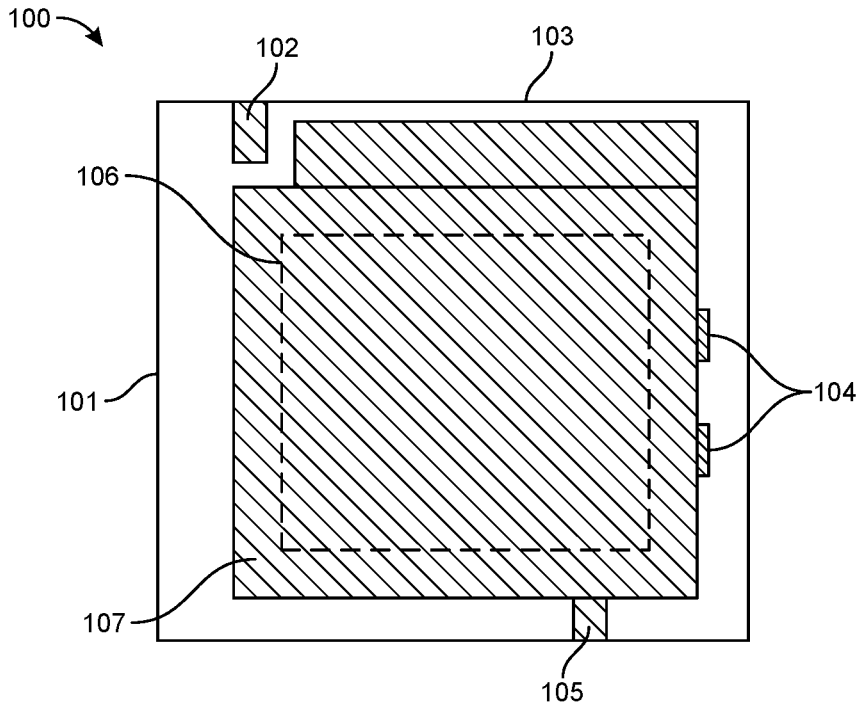
FIG. 1 illustrates a top view of an embodiment of an enclosure and back cover portion including one or more components of an elevated feed antenna for implementation in wearable electronic devices.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the present disclosure covers all modifications, equivalents, and alternatives falling within the scope of the appended claims.

DETAILED DESCRIPTION OF EXEMPLARY EMBODIMENTS

The present disclosure is generally directed to an antenna structure for use in wireless electronic devices that have conductive enclosures (e.g., smartwatches, artificial reality devices, etc.). Some wireless devices have attempted to improve antenna functionality in devices enclosed by metallic or other electrically conductive structures. For instance, some wireless devices have cut micro-slots into the sides of the device's enclosure to make use of the metal segments as antennas. However, devices that include these slots need to have these slots filled with plastic or other non-conductive material to maintain an environmental water seal. This non-conductive material that is added to the slots may present weak points on the device, and may cause the device to fail drop tests and lead to other reliability concerns.

In contrast, the embodiments described herein may provide antenna architectures that are designed to work with fully intact, conductive (e.g., metallic) enclosures and do not require any slots or alterations to the enclosure. In some cases, the antennas described herein may be applied to a bottom layer of a device that may be made from plastic or other non-conductive material. In some cases, the antennas may be applied using laser direct structuring (LDS) to the plastic bottom layer to form a conductive portion. In such cases, the LDS technique may metalize portions of the plastic (non-conductive) bottom layer, making those portions conductive. The antenna(s) may then be connected directly to one side of the metallic enclosure. The antennas may be connected to respective antenna feeding structures that link RF systems embedded on a printed circuit board (PCB) or other substrate to the antenna. As such, the metallic enclosure and the conductive portion on the bottom layer may be combined as radiating elements of an antenna.

In some cases, the antennas' feeding structure starting from the PCB may be elevated to the non-conductive bottom layer that contains the antennas. In some cases, the antenna feed structure may be connected to a separate (isolated) conductive portion on the bottom layer and may further be connected through that isolated portion to the opposite side of the metallic enclosure. Such an antenna architecture may provide improved long-term evolution (LTE) low-band antenna performance (e.g., in the 600 MHz-900 MHz cellular range) and may provide wider bandwidth. Alternative embodiments may implement a cable to directly connect the PCB and the antenna portion on the bottom layer to feed the metallic enclosure. These embodiments will all be described further below with reference to FIGS. 1-9B.

Features from any of the embodiments described herein may be used in combination with one another in accordance with the general principles described herein. These and other embodiments, features, and advantages will be more fully understood upon reading the following detailed description in conjunction with the accompanying drawings and claims.

FIG. 1 illustrates an embodiment 100 of an antenna architecture 101. The antenna architecture 101 may include multiple different component parts. For example, the antenna architecture 101 may include a conductive enclosure 103 (this may also be referred to herein as a metal enclosure). The conductive enclosure 103 may be made of substantially any type of electrically conductive material, whether that material is fully conductive or only partially conductive. The conductive enclosure may be a housing or outer protective component that holds one or more interior components inside the device. The interior components housed inside the conductive enclosure 103 may include electronic components such as antennas (e.g., 106), antenna feed structure, printed circuit boards, batteries, microprocessors, memory devices, data storage devices, cameras, or other electronic components, at least some of which may be embedded on a printed circuit board.

In some cases, the antenna architecture 101 may include a short connection 105 to the metal enclosure 103. This short connection may allow the metal enclosure 103 to act as a radiating element of the antenna 106. As such, both the traces of the antenna 106 disposed on the substrate layer 107 and the metal enclosure itself may act as radiating elements for the antenna. The antenna 106 (including the metal enclosure) may be fed from an antenna feed 102 that is disposed on the substrate layer 107 to the enclosure 103. The PCB may be elevated above the substrate layer 107, and may include antenna feed components including tuners, amplifiers, impedance matching circuits, signal processors, or other components. While FIG. 1 shows a single antenna 106 and a single antenna feed, it will be recognized that substantially any number of antennas and antenna feeds may be included in the antenna architecture 101. The antenna architecture 101 may also include shorting pins 104 that may short to some portion of the PCB. These shorting pins 104 may attach to specific points on the antenna 106. Then, using electrical control signals, these shorting pins 104 may be used to tune the antenna to the correct operating frequencies. These embodiments may be further illustrated in the side view diagram of FIG. 2.

Figure 2:
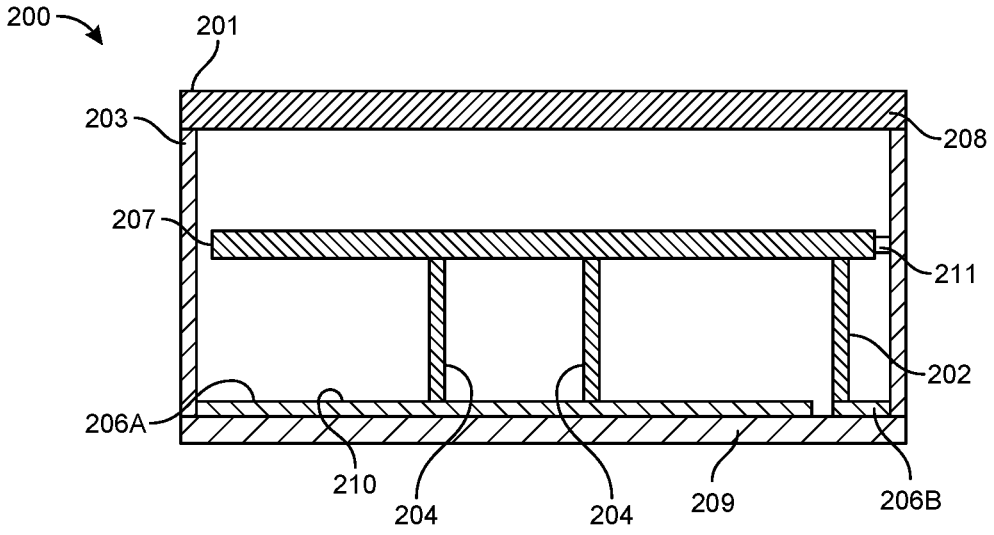
FIG. 2 illustrates side view of an embodiment of one or more components of an elevated feed antenna for wearable electronic devices.

FIG. 2 illustrates an embodiment 200 of an antenna architecture 201 that includes various electronic components. The antenna architecture 201 may include, for example, a metal enclosure 203. The metal enclosure 203 may be made of substantially any type of conductive material including metals such as aluminum, titanium, copper, or other metals or metal alloys, or conductive foam or similar materials. The metal enclosure 203 may be formed in various shapes including rectangular, square, circular (e.g., ring-shaped), or in some other shape. In some cases, for example, the metal enclosure 203 may wrap around or enclose various portions of the antenna architecture 201. In some cases, as shown in FIG. 2, the metal enclosure 203 may form one or more sides of a wearable device (e.g., four sides of a device, as generally shown in FIG. 1). The top portion of the wearable device may be a display 208 such as a touchscreen display. The bottom portion of the wearable device may be generally non-conductive, but may have conductive portions applied thereto (e.g., using laser direct structuring).

The antenna architecture 201 may further include a PCB 207 that may have various electronic components disposed or embedded thereon. The electronic components may include cameras, processors, memory chips, data storage devices, batteries, antennas, amplifiers, tuners, or other antenna matching components.

For example, as shown in embodiment 200 of FIG. 2, the bottom layer or back cover layer 209 may have a conductive antenna 210 disposed on its inner surface. The inner surface of the back cover layer 209 may include one, two, or more different sections (e.g., 206A/206B). Each of these sections may be electrically isolated from the other sections. Thus, in FIG. 2, one section of the back cover layer 209 (e.g., section 206A) may include one or more antennas disposed thereon, and another section of the back cover layer 209 (e.g., section 206B) may include a connection to the metal enclosure 203. Thus, in such cases, the antenna feed structure 202 from the PCB 207 may be fed through the isolated conductive section 206B on the inner surface of the back cover layer 209 to the metal enclosure 203. Thus, instead of feeding the antenna 210 directly from the PCB, the embodiments herein may indirectly feed the metal enclosure 203 through the isolated conductive section 206B. In this manner, in the embodiments herein, the metal enclosure may be part of the one or more antennas 210 of the wearable electronic device. By using the metal enclosure 203 as a radiating element, manufacturing steps taken to make the enclosure RF transparent may not be necessary and may be avoided.

In some embodiments, the antenna architecture 201 may include shorting pins 204. While the embodiment 200 is shown as having two shorting pins, it will be recognized that the antenna architecture 201 may include zero, one, two, three, or more shorting pins. In some cases, these shorting pins 204 may connect the antenna 210 on the inner surface 206A of the back cover layer 209 to one or more electronic components on PCB 207. In some cases, the PCB 207 may include a controller and one or more switches that control when the shorting pins are activated or when the pins remain inactivated. By activating or leaving one or more of the shorting pins inactivated, the controller may change the tuning characteristics of the antenna 210. Thus, for instance, the antenna 210 may be changed from operating at a higher frequency to operating at a lower frequency, or may be changed from operating at a lower frequency to operating at a higher frequency. At least in some embodiments, an additional short connection 211 may be provided from the PCB 207 directly to the metal enclosure 203. This short connection 211 may be implemented to tune the antenna 210 as illustrated in FIG. 2.

In the embodiment 200 of FIG. 2, the PCB 207 may be elevated off of the back cover layer 209 and may include three or more connecting elements (e.g., 204 and 202) that may span the distance between the elevated PCB 207 and the back cover layer 209. In some cases, this distance may be a minimum specified distance (e.g., 1 mm, 2 mm, 5 mm, 10 mm, etc.). This minimum specified distance may allow, for example, placement of cameras, batteries, or other electronic components between the elevated PCB 207 and the inner surface of the back cover layer 209.

In some embodiments, a system may be provided. The system may include a housing that includes a non-conducting substrate and a conductive enclosure that at least partially surrounds the non-conducting substrate. In such cases, the system may have a housing that is made of a non-conducting substrate (e.g., a non-conducting (plastic) back cover layer 209) and a conductive enclosure (e.g., the metal enclosure 203 of FIG. 2). The housing may have openings (e.g., in the non-conducting substrate) that allow for heart rate sensors, cameras, or other sensors. The system may further include one or more antennas such as GPS and WiFi antennas disposed on the non-conducting substrate of the housing. The antenna pattern or shape may be the same as or different than the antenna 210 of FIG. 2. The antenna may be substantially any type of antenna including a monopole, loop, or other type of antenna. The antenna may be designed to operate within a certain frequency band and may be, for example, a WiFi antenna, a Bluetooth antenna, a global positioning system (GPS) antenna, a near field communication (NFC) antenna, a cellular antenna (e.g., long term evolution (LTE) antenna), or other type of antenna. In some cases, the system may include many different kinds of antennas within the same device.

In some embodiments, the system may include a direct electrical connection between the antenna and a first portion of the conductive enclosure. For instance, as shown in FIG. 1, the antenna 106 may be directly connected to the metal enclosure 103 via a short connection 105. The system may also include an antenna feed that is electrically connected to a separate conductive portion on the non-conducting substrate (e.g., 102 or 206B). That separate portion may be electrically connected to a different portion of the conductive enclosure (e.g., the top side of the metal enclosure 103). These connections to the conductive enclosure 103 may allow the system to use the conductive enclosure 103 as a radiating element in an antenna.

As shown in FIG. 2, the system may include a PCB 207 that itself includes one or more electronic components of the antenna feed structure 202. The PCB may be elevated off of the non-conducting substrate (e.g., 209). In such cases, a gap may exist between the PCB and the non-conducting substrate. This gap may allow for components such as cameras, batteries, or other components to be placed on both sides of the PCB. The gap may be different in different systems and may be higher or lower to accommodate specific electronic and/or mechanical components. In some cases, the system may include shorting pins that electrically connect the antenna disposed on the non-conducting substrate to the PCB. As noted above, these shorting pins 204 may allow the antenna 210 to be tuned to a specific frequency or to a specific frequency range.

Figure 3:
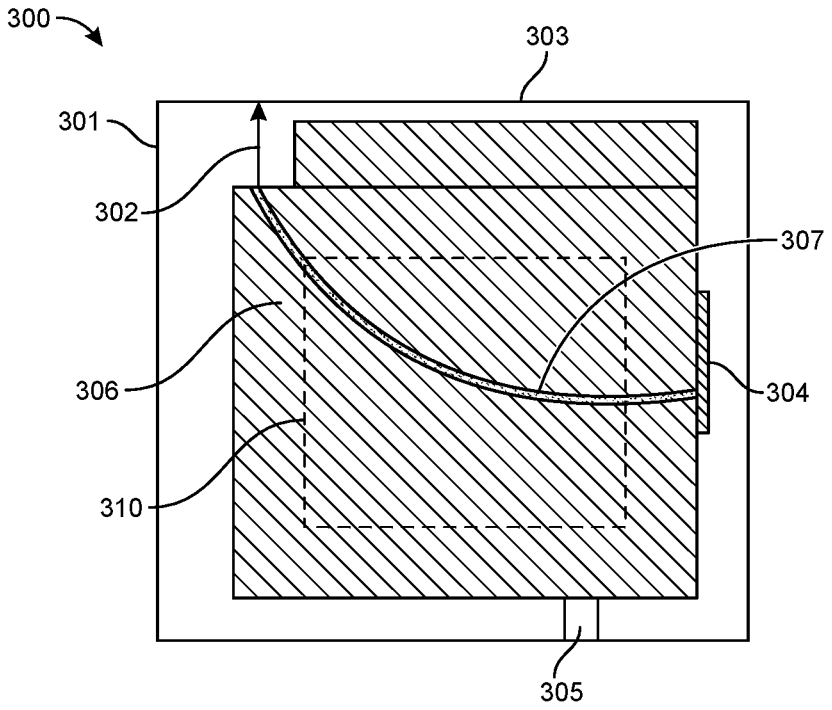
FIG. 3 illustrates a top view of an alternative embodiment of an enclosure and back cover portion including a transmission line and other components of an elevated feed antenna for wearable electronic devices.
Figure 4:
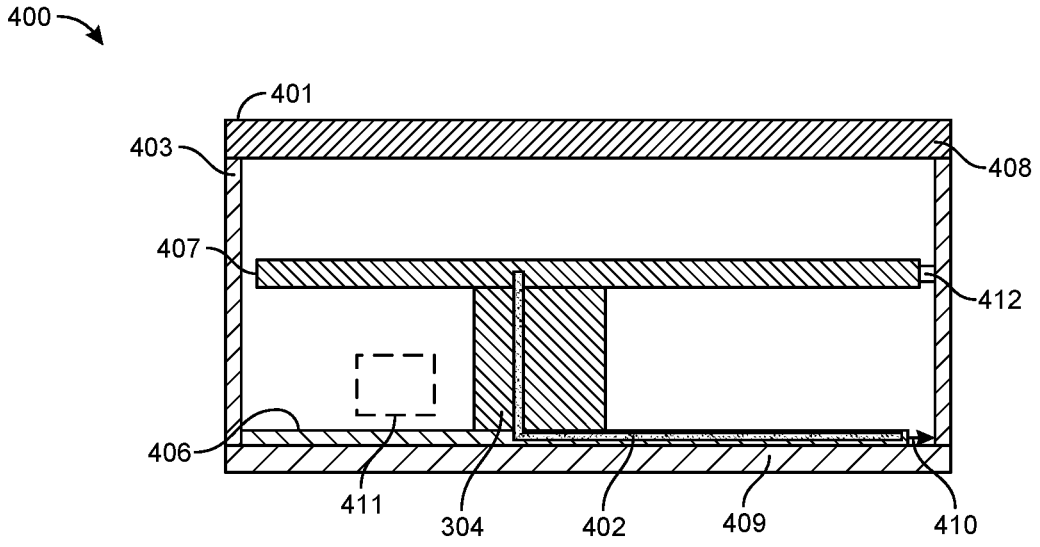
FIG. 4 illustrates side view of an alternative embodiment of one or more components of an elevated feed antenna for wearable electronic devices.

In some embodiments, as illustrated in embodiments 300 and 400 of FIGS. 3 and 4, the PCB and the various electronic components of the antenna feed may be electrically connected to the conductive enclosure via a conductive element. Thus, for instance, the antenna architecture 301 may include an antenna 310 disposed on a substrate 306. As above, the antenna may be any type of antenna including monopole, loop, etc., and may be designed to function in substantially any frequency range. The antenna architecture 301 may include a conductive enclosure 303 that may be made of metal or other conductive material. The antenna architecture 301 may also include a direct shorting connection 305 that may connect the antenna 310 directly to the conductive enclosure 303. The antenna architecture 301 may further include a transmission line 307 such as a coaxial cable that may be attached to 306 (for example, by soldering). The inner conductor 302 may connect to the conductive enclosure 303 as an antenna feed. In some cases, the other end of the transmission line 307 may be connected to an RF system on the PCB. This may be seen in the side view of FIG. 4.

FIG. 4 illustrates an embodiment of an antenna architecture 401 that may include a PCB 407 that is directly linked to the conductive enclosure 403 via a transmission line such as coaxial cable 402. The cable 402 may electrically connect to the RF system on the PCB 407 and the inner conductor 410 of the cable may feed the conductive enclosure 403. The cable 402 may be attached to the antenna 406 and may run along the inner surface of the back cover layer 409 that lies opposite to a display 408 on the top side of the device. Thus, in this example embodiment, a cable 402 may be implemented instead of having an isolated conductive portion on the substrate.

In this embodiment, the cable 402 directly connects the antenna feed components on the PCB 407 to the conductive (metal) enclosure 403 at 410. Moreover, in this embodiment, the PCB 407 may be elevated above the antenna 406 and the back cover layer 409. Still further, the antenna architecture 401 may include one or more shorting grounding connections (e.g., 412) between the PCB 407 and the metal enclosure 403 as shown in FIG. 4. The elevated PCB may allow for placement of components such as a camera 411 or other components. The antenna of this embodiment may be applied to the inner surface of the non-conducting substrate in a variety of different manners, including via laser direct structuring (LDS) or other similar methods. The embodiments 300/400 of FIGS. 3 and 4 may allow wearable devices to use their metal enclosures as radiating elements, and may avoid having to cut slots or holes into the enclosure to allow for the ingress or egress of electromagnetic radiation.

Figure 5:
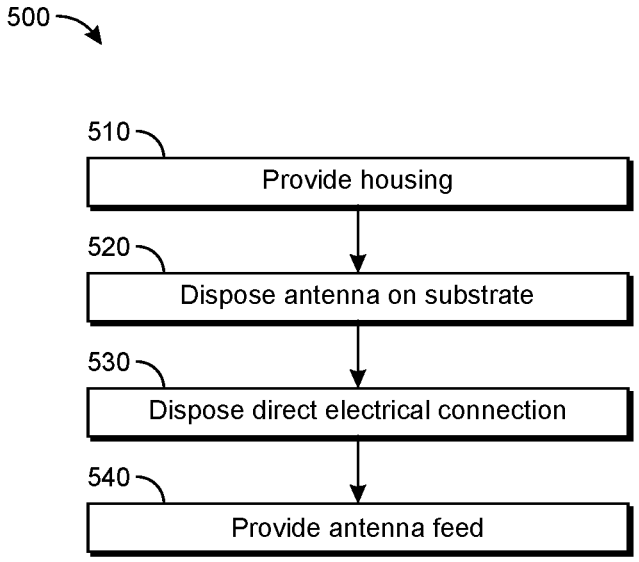
FIG. 5 is a flow diagram of an exemplary method of manufacturing for providing an elevated feed antenna for wearable electronic devices.

FIG. 5 is a flow diagram of an exemplary method of manufacturing 500 for manufacturing a wearable electronic device. The steps shown in FIG. 5 may be performed by any suitable pieces of industrial manufacturing equipment and may be controlled via computer-executable code and/or computing systems. In one example, each of the steps shown in FIG. 5 may represent an algorithm whose structure includes and/or is represented by multiple sub-steps, examples of which will be provided in greater detail below.

As illustrated in FIG. 5, at step 510, one or more of the systems described herein may provide a housing that includes a non-conducting substrate and a conductive enclosure that at least partially surrounds the non-conducting substrate. Then, at step 520 the systems herein may dispose an antenna on the non-conducting substrate of the housing and, at step 530, may dispose a direct electrical connection between the antenna and a first portion of the conductive enclosure. Further, at step 540, the systems herein may provide an antenna feed electrically connected to a separate conductive portion on the non-conducting substrate. At least in some cases, the separate portion of the non-conducting substrate may be electrically connected to a second portion of the conductive enclosure.

In some cases, the method of manufacturing 500 may be implemented to manufacture or otherwise produce or create a wearable electronic device, or may be implemented to manufacture one or more components of a wearable electronic device. These components may include antennas, substrates, metal enclosures, PCBs, plastic backing plates, displays, buttons, sensors, or other components. The systems herein may assemble, provide, dispose, or otherwise create and/or combine these components to produce a wearable electronic device. In some cases, the PCB of the wearable electronic device may be manufactured in a manner that elevates the PCB up off of the (plastic) back cover layer. Manufacturing in this manner may result in an elevated PCB that includes a gap between the PCB and the non-conducting substrate. The gap may allow room for cameras or other components that, in other devices, may have been relegated to other, less optimal locations.

Such a wearable electronic device may be manufactured using either an antenna feed structure that travels through a non-conducting substrate to electrically link the PCB to the conductive enclosure through the separate conductive portion on the non-conducting substrate (as generally shown in FIGS. 1 & 2), or using an antenna feed transmission line that travels through the non-conducting substrate like a cable that directly electrically links the PCB to the conductive enclosure (as generally shown in FIGS. 3 & 4). In either or both cases, the antenna(s) may be electrically connected to the conductive enclosure and may further be grounded to the PCB. In at least some embodiments described here, these antennas may operate in the frequency range of 600 MHz-2600 MHz, or in frequency ranges that are higher or lower than 600-2600 MHz.

By manufacturing or otherwise providing wearable electronic devices that use the conductive enclosure as a radiating element, the embodiments herein may avoid cutting slots or holes into the device's conductive housing, which may improve drop test results, and may further improve durability against water, dust, or other performance-degrading elements.

EXAMPLE EMBODIMENTS

Example 1: A system may include a housing that includes a non-conducting substrate and a conductive enclosure that at least partially surrounds the non-conducting substrate, an antenna disposed on the non-conducting substrate of the housing, a direct electrical connection between the antenna and a first portion of the conductive enclosure, and an antenna feed electrically connected to a separate conductive portion on the non-conducting substrate, wherein the separate conductive portion on the non-conducting substrate is electrically connected to a second portion of the conductive enclosure.

Example 2: The system of Example 1, further comprising a printed circuit board (PCB) that includes one or more electronic components of the antenna feed.

Example 3: The system of Example 1 or Example 2, wherein the PCB is elevated off of the non-conducting substrate, such that a gap exists between the PCB and the non-conducting substrate.

Example 4: The system of any of Examples 1-3, further comprising one or more shorting pins that electrically connect the antenna disposed on the non-conducting substrate to the PCB.

Example 5: The system of any of Examples 1-4, wherein the one or more shorting pins are selected to tune the antenna to a specified frequency.

Example 6: The system of any of Examples 1-5, wherein the PCB including the one or more electronic components of the antenna feed is electrically connected to the conductive enclosure via a conductive element.

Example 7: The system of any of Examples 1-6, wherein the conductive element comprises a cable that electrically connects an RF system on the PCB to feed the conductive enclosure.

Example 8: The system of any of Examples 1-7, wherein the antenna is applied to the non-conducting substrate using laser direct structuring (LDS).

Example 9: The system of any of Examples 1-8, wherein the conductive enclosure comprises a metallic enclosure.

Example 10: The system of any of Examples 1-9, wherein the metallic enclosure at least partially surrounds a printed circuit board.

Example 11: The system of any of Examples 1-10, wherein the separate conductive portion of the non-conducting substrate is electrically isolated from the non-conducting substrate.

Example 12: A wearable electronic device may include a housing that includes a non-conducting substrate and a conductive enclosure that at least partially surrounds the non-conducting substrate, an antenna disposed on the non-conducting substrate of the housing, a direct electrical connection between the antenna and a first portion of the conductive enclosure, and an antenna feed electrically connected to a separate conductive portion on the non-conducting substrate, wherein the separate conductive portion on the non-conducting substrate is electrically connected to a second portion of the conductive enclosure.

Example 13: The wearable electronic device of Example 12, further comprising a PCB that includes one or more electronic components of the antenna feed.

Example 14: The wearable electronic device of Example 12 or Example 13, wherein the PCB is elevated off of the non-conducting substrate, such that a gap exists between the PCB and the non-conducting substrate.

Example 15: The wearable electronic device of any of Examples 12-14, further comprising at least one camera positioned in the gap between the PCB and the non-conducting substrate.

Example 16: The wearable electronic device of any of Examples 12-15, wherein the antenna feed electrically links the PCB to the conductive enclosure through the separate conductive portion on the non-conducting substrate.

Example 17: The wearable electronic device of any of Examples 12-16, wherein the antenna feed directly electrically links the PCB to the conductive enclosure using a cable.

Example 18: The wearable electronic device of any of Examples 12-17, wherein the antenna is electrically connected to the conductive enclosure and is further grounded to the PCB.

Example 19: The wearable electronic device of any of Examples 12-18, wherein the antenna is configured to operate between 600 MHz-2600 MHz.

Example 20: A method of manufacturing may include providing a housing that includes a non-conducting substrate and a conductive enclosure that at least partially surrounds the non-conducting substrate, disposing an antenna on the non-conducting substrate of the housing, disposing a direct electrical connection between the antenna and a first portion of the conductive enclosure, and providing an antenna feed electrically connected to a separate conductive portion on the non-conducting substrate, wherein the separate conductive portion on the non-conducting substrate is electrically connected to a second portion of the conductive enclosure.

Embodiments of the present disclosure may include or be implemented in conjunction with various types of artificial-reality systems. Artificial reality is a form of reality that has been adjusted in some manner before presentation to a user, which may include, for example, a virtual reality, an augmented reality, a mixed reality, a hybrid reality, or some combination and/or derivative thereof. Artificial-reality content may include completely computer-generated content or computer-generated content combined with captured (e.g., real-world) content. The artificial-reality content may include video, audio, haptic feedback, or some combination thereof, any of which may be presented in a single channel or in multiple channels (such as stereo video that produces a three-dimensional (3D) effect to the viewer). Additionally, in some embodiments, artificial reality may also be associated with applications, products, accessories, services, or some combination thereof, that are used to, for example, create content in an artificial reality and/or are otherwise used in (e.g., to perform activities in) an artificial reality.

Artificial-reality systems may be implemented in a variety of different form factors and configurations. Some artificial-reality systems may be designed to work without near-eye displays (NEDs). Other artificial-reality systems may include an NED that also provides visibility into the real world (such as, e.g., augmented-reality system 600 in FIG. 6) or that visually immerses a user in an artificial reality (such as, e.g., virtual-reality system 700 in FIG. 7). While some artificial-reality devices may be self-contained systems, other artificial-reality devices may communicate and/or coordinate with external devices to provide an artificial-reality experience to a user. Examples of such external devices include handheld controllers, mobile devices, desktop computers, devices worn by a user, devices worn by one or more other users, and/or any other suitable external system.

Figure 6:
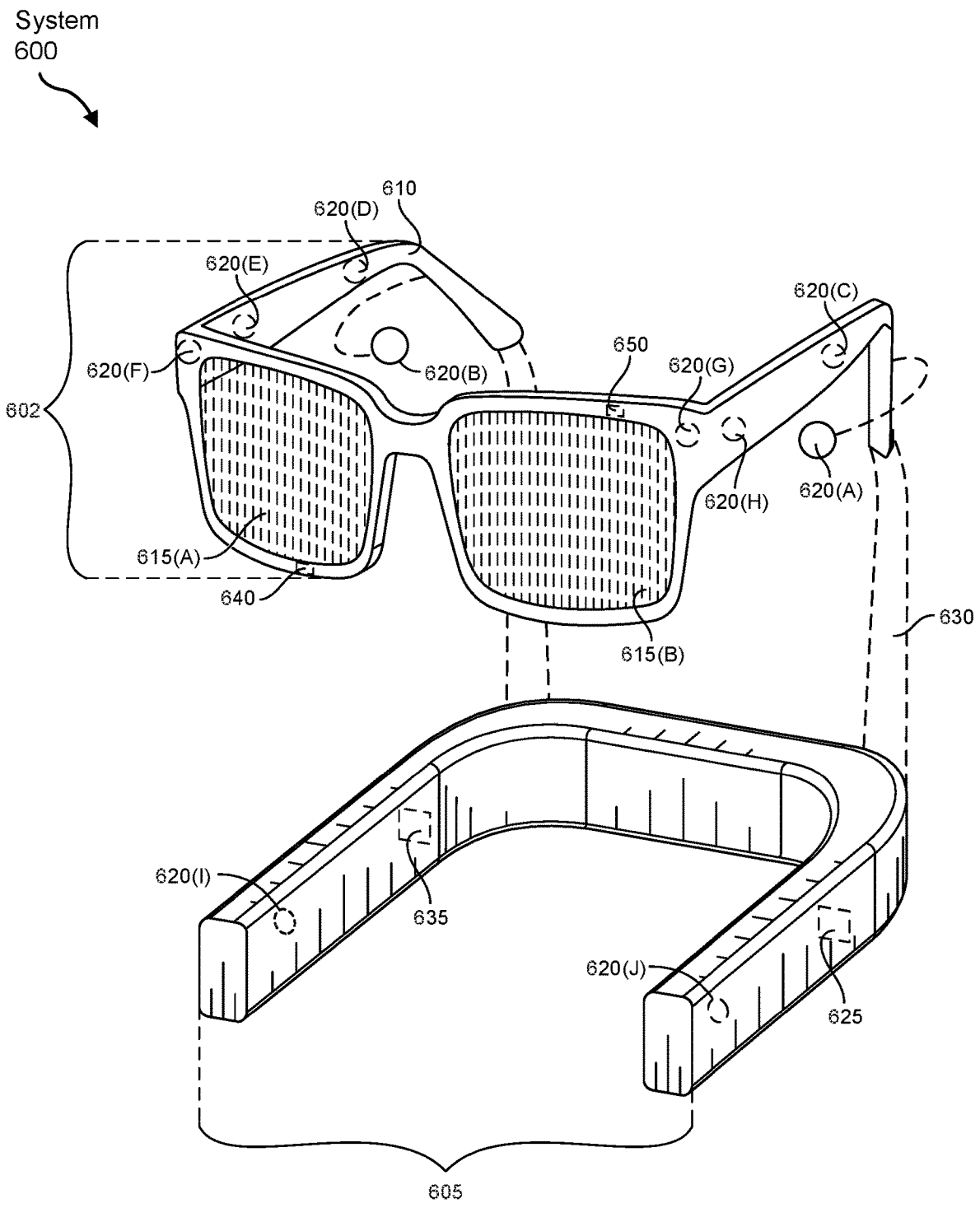
FIG. 6 is an illustration of exemplary augmented-reality glasses that may be used in connection with embodiments of this disclosure.
Figure 7:
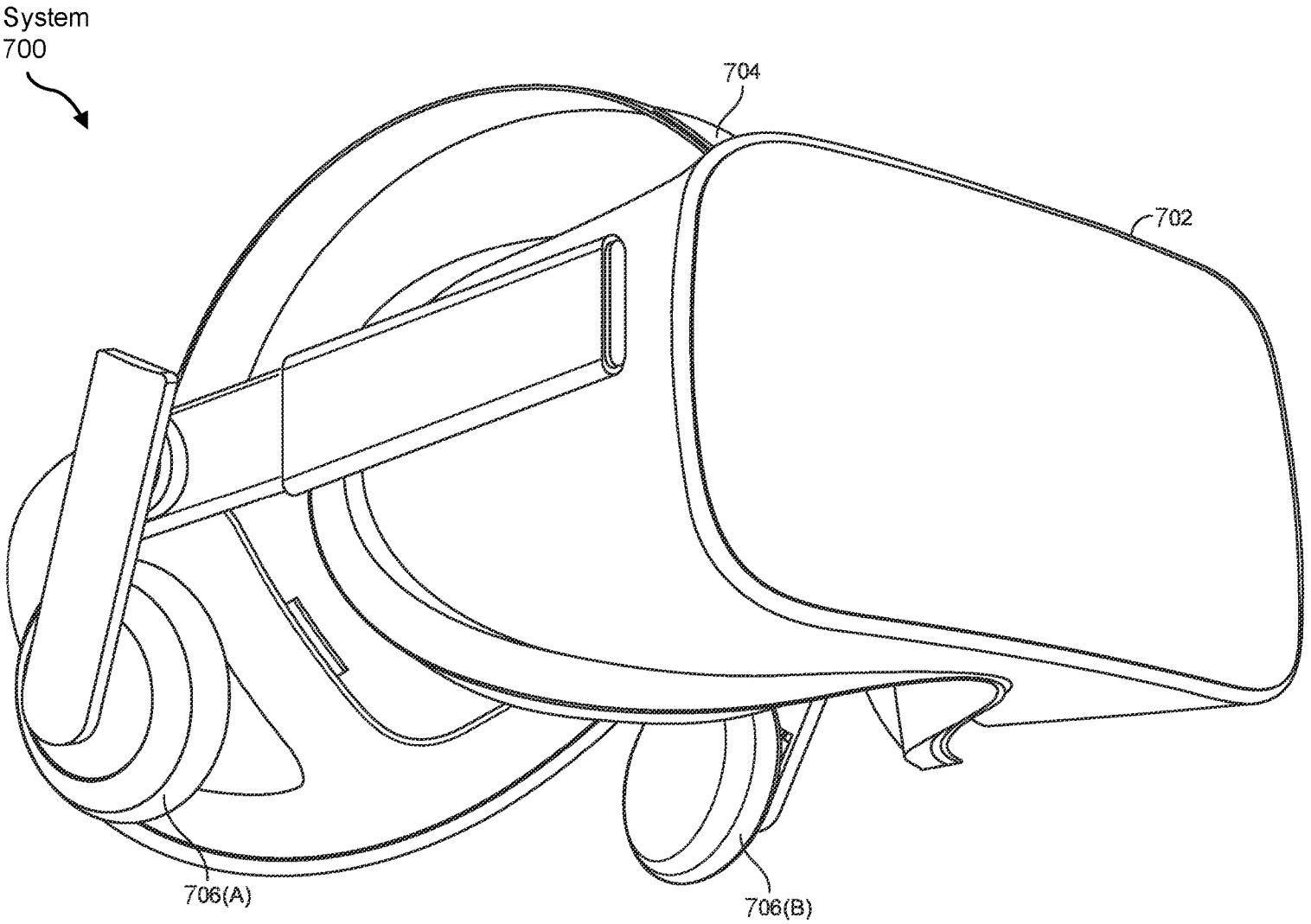
FIG. 7 is an illustration of an exemplary virtual-reality headset that may be used in connection with embodiments of this disclosure.

Turning to FIG. 6, augmented-reality system 600 may include an eyewear device 602 with a frame 610 configured to hold a left display device 615(A) and a right display device 615(B) in front of a user's eyes. Display devices 615(A) and 615(B) may act together or independently to present an image or series of images to a user. While augmented-reality system 600 includes two displays, embodiments of this disclosure may be implemented in augmented-reality systems with a single NED or more than two NEDs.

In some embodiments, augmented-reality system 600 may include one or more sensors, such as sensor 640. Sensor 640 may generate measurement signals in response to motion of augmented-reality system 600 and may be located on substantially any portion of frame 610. Sensor 640 may represent one or more of a variety of different sensing mechanisms, such as a position sensor, an inertial measurement unit (IMU), a depth camera assembly, a structured light emitter and/or detector, or any combination thereof. In some embodiments, augmented-reality system 600 may or may not include sensor 640 or may include more than one sensor. In embodiments in which sensor 640 includes an IMU, the IMU may generate calibration data based on measurement signals from sensor 640. Examples of sensor 640 may include, without limitation, accelerometers, gyroscopes, magnetometers, other suitable types of sensors that detect motion, sensors used for error correction of the IMU, or some combination thereof.

In some examples, augmented-reality system 600 may also include a microphone array with a plurality of acoustic transducers 620(A)-620(J), referred to collectively as acoustic transducers 620. Acoustic transducers 620 may represent transducers that detect air pressure variations induced by sound waves. Each acoustic transducer 620 may be configured to detect sound and convert the detected sound into an electronic format (e.g., an analog or digital format). The microphone array in FIG. 6 may include, for example, ten acoustic transducers: 620(A) and 620(B), which may be designed to be placed inside a corresponding ear of the user, acoustic transducers 620(C), 620(D), 620(E), 620(F), 620(G), and 620(H), which may be positioned at various locations on frame 610, and/or acoustic transducers 620(1) and 620(J), which may be positioned on a corresponding neckband 605.

In some embodiments, one or more of acoustic transducers 620(A)-(J) may be used as output transducers (e.g., speakers). For example, acoustic transducers 620(A) and/or 620(B) may be earbuds or any other suitable type of headphone or speaker.

The configuration of acoustic transducers 620 of the microphone array may vary. While augmented-reality system 600 is shown in FIG. 6 as having ten acoustic transducers 620, the number of acoustic transducers 620 may be greater or less than ten. In some embodiments, using higher numbers of acoustic transducers 620 may increase the amount of audio information collected and/or the sensitivity and accuracy of the audio information. In contrast, using a lower number of acoustic transducers 620 may decrease the computing power required by an associated controller 650 to process the collected audio information. In addition, the position of each acoustic transducer 620 of the microphone array may vary. For example, the position of an acoustic transducer 620 may include a defined position on the user, a defined coordinate on frame 610, an orientation associated with each acoustic transducer 620, or some combination thereof.

Acoustic transducers 620(A) and 620(B) may be positioned on different parts of the user's ear, such as behind the pinna, behind the tragus, and/or within the auricle or fossa. Or, there may be additional acoustic transducers 620 on or surrounding the ear in addition to acoustic transducers 620 inside the ear canal. Having an acoustic transducer 620 positioned next to an ear canal of a user may enable the microphone array to collect information on how sounds arrive at the ear canal. By positioning at least two of acoustic transducers 620 on either side of a user's head (e.g., as binaural microphones), augmented-reality system 600 may simulate binaural hearing and capture a 3D stereo sound field around about a user's head. In some embodiments, acoustic transducers 620(A) and 620(B) may be connected to augmented-reality system 600 via a wired connection 630, and in other embodiments acoustic transducers 620(A) and 620(B) may be connected to augmented-reality system 600 via a wireless connection (e.g., a BLUETOOTH connection). In still other embodiments, acoustic transducers 620(A) and 620(B) may not be used at all in conjunction with augmented-reality system 600.

Acoustic transducers 620 on frame 610 may be positioned in a variety of different ways, including along the length of the temples, across the bridge, above or below display devices 615(A) and 615(B), or some combination thereof. Acoustic transducers 620 may also be oriented such that the microphone array is able to detect sounds in a wide range of directions surrounding the user wearing the augmented-reality system 600. In some embodiments, an optimization process may be performed during manufacturing of augmented-reality system 600 to determine relative positioning of each acoustic transducer 620 in the microphone array.

In some examples, augmented-reality system 600 may include or be connected to an external device (e.g., a paired device), such as neckband 605. Neckband 605 generally represents any type or form of paired device. Thus, the following discussion of neckband 605 may also apply to various other paired devices, such as charging cases, smart watches, smart phones, wrist bands, other wearable devices, hand-held controllers, tablet computers, laptop computers, other external compute devices, etc.

As shown, neckband 605 may be coupled to eyewear device 602 via one or more connectors. The connectors may be wired or wireless and may include electrical and/or non-electrical (e.g., structural) components. In some cases, eyewear device 602 and neckband 605 may operate independently without any wired or wireless connection between them. While FIG. 6 illustrates the components of eyewear device 602 and neckband 605 in example locations on eyewear device 602 and neckband 605, the components may be located elsewhere and/or distributed differently on eyewear device 602 and/or neckband 605. In some embodiments, the components of eyewear device 602 and neckband 605 may be located on one or more additional peripheral devices paired with eyewear device 602, neckband 605, or some combination thereof.

Pairing external devices, such as neckband 605, with augmented-reality eyewear devices may enable the eyewear devices to achieve the form factor of a pair of glasses while still providing sufficient battery and computation power for expanded capabilities. Some or all of the battery power, computational resources, and/or additional features of augmented-reality system 600 may be provided by a paired device or shared between a paired device and an eyewear device, thus reducing the weight, heat profile, and form factor of the eyewear device overall while still retaining desired functionality. For example, neckband 605 may allow components that would otherwise be included on an eyewear device to be included in neckband 605 since users may tolerate a heavier weight load on their shoulders than they would tolerate on their heads. Neckband 605 may also have a larger surface area over which to diffuse and disperse heat to the ambient environment. Thus, neckband 605 may allow for greater battery and computation capacity than might otherwise have been possible on a stand-alone eyewear device. Since weight carried in neckband 605 may be less invasive to a user than weight carried in eyewear device 602, a user may tolerate wearing a lighter eyewear device and carrying or wearing the paired device for greater lengths of time than a user would tolerate wearing a heavy standalone eyewear device, thereby enabling users to more fully incorporate artificial-reality environments into their day-to-day activities.

Neckband 605 may be communicatively coupled with eyewear device 602 and/or to other devices. These other devices may provide certain functions (e.g., tracking, localizing, depth mapping, processing, storage, etc.) to augmented-reality system 600. In the embodiment of FIG. 6, neckband 605 may include two acoustic transducers (e.g., 620(1) and 620(J)) that are part of the microphone array (or potentially form their own microphone subarray). Neckband 605 may also include a controller 625 and a power source 635.

Acoustic transducers 620(1) and 620(J) of neckband 605 may be configured to detect sound and convert the detected sound into an electronic format (analog or digital). In the embodiment of FIG. 6, acoustic transducers 620(1) and 620(J) may be positioned on neckband 605, thereby increasing the distance between the neckband acoustic transducers 620(1) and 620(J) and other acoustic transducers 620 positioned on eyewear device 602. In some cases, increasing the distance between acoustic transducers 620 of the microphone array may improve the accuracy of beamforming performed via the microphone array. For example, if a sound is detected by acoustic transducers 620(C) and 620(D) and the distance between acoustic transducers 620(C) and 620(D) is greater than, e.g., the distance between acoustic transducers 620(D) and 620(E), the determined source location of the detected sound may be more accurate than if the sound had been detected by acoustic transducers 620(D) and 620(E).

Controller 625 of neckband 605 may process information generated by the sensors on neckband 605 and/or augmented-reality system 600. For example, controller 625 may process information from the microphone array that describes sounds detected by the microphone array. For each detected sound, controller 625 may perform a direction-of-arrival (DOA) estimation to estimate a direction from which the detected sound arrived at the microphone array. As the microphone array detects sounds, controller 625 may populate an audio data set with the information. In embodiments in which augmented-reality system 600 includes an inertial measurement unit, controller 625 may compute all inertial and spatial calculations from the IMU located on eyewear device 602. A connector may convey information between augmented-reality system 600 and neckband 605 and between augmented-reality system 600 and controller 625. The information may be in the form of optical data, electrical data, wireless data, or any other transmittable data form. Moving the processing of information generated by augmented-reality system 600 to neckband 605 may reduce weight and heat in eyewear device 602, making it more comfortable to the user.

Power source 635 in neckband 605 may provide power to eyewear device 602 and/or to neckband 605. Power source 635 may include, without limitation, lithium ion batteries, lithium-polymer batteries, primary lithium batteries, alkaline batteries, or any other form of power storage. In some cases, power source 635 may be a wired power source. Including power source 635 on neckband 605 instead of on eyewear device 602 may help better distribute the weight and heat generated by power source 635.

As noted, some artificial-reality systems may, instead of blending an artificial reality with actual reality, substantially replace one or more of a user's sensory perceptions of the real world with a virtual experience. One example of this type of system is a head-worn display system, such as virtual-reality system 700 in FIG. 7, that mostly or completely covers a user's field of view. Virtual-reality system 700 may include a front rigid body 702 and a band 704 shaped to fit around a user's head. Virtual-reality system 700 may also include output audio transducers 706(A) and 706(B). Furthermore, while not shown in FIG. 7, front rigid body 702 may include one or more electronic elements, including one or more electronic displays, one or more inertial measurement units (IMUS), one or more tracking emitters or detectors, and/or any other suitable device or system for creating an artificial-reality experience.

Artificial-reality systems may include a variety of types of visual feedback mechanisms. For example, display devices in augmented-reality system 600 and/or virtual-reality system 700 may include one or more liquid crystal displays (LCDs), light emitting diode (LED) displays, microLED displays, organic LED (OLED) displays, digital light processing (DLP) micro-displays, liquid crystal on silicon (LCoS) micro-displays, and/or any other suitable type of display screen. These artificial-reality systems may include a single display screen for both eyes or may provide a display screen for each eye, which may allow for additional flexibility for varifocal adjustments or for correcting a user's refractive error. Some of these artificial-reality systems may also include optical subsystems having one or more lenses (e.g., concave or convex lenses, Fresnel lenses, adjustable liquid lenses, etc.) through which a user may view a display screen. These optical subsystems may serve a variety of purposes, including to collimate (e.g., make an object appear at a greater distance than its physical distance), to magnify (e.g., make an object appear larger than its actual size), and/or to relay (to, e.g., the viewer's eyes) light. These optical subsystems may be used in a non-pupil-forming architecture (such as a single lens configuration that directly collimates light but results in so-called pincushion distortion) and/or a pupil-forming architecture (such as a multi-lens configuration that produces so-called barrel distortion to nullify pincushion distortion).

In addition to or instead of using display screens, some of the artificial-reality systems described herein may include one or more projection systems. For example, display devices in augmented-reality system 600 and/or virtual-reality system 700 may include microLED projectors that project light (using, e.g., a waveguide) into display devices, such as clear combiner lenses that allow ambient light to pass through. The display devices may refract the projected light toward a user's pupil and may enable a user to simultaneously view both artificial-reality content and the real world. The display devices may accomplish this using any of a variety of different optical components, including waveguide components (e.g., holographic, planar, diffractive, polarized, and/or reflective waveguide elements), light-manipulation surfaces and elements (such as diffractive, reflective, and refractive elements and gratings), coupling elements, etc. Artificial-reality systems may also be configured with any other suitable type or form of image projection system, such as retinal projectors used in virtual retina displays.

The artificial-reality systems described herein may also include various types of computer vision components and subsystems. For example, augmented-reality system 600 and/or virtual-reality system 700 may include one or more optical sensors, such as two-dimensional (2D) or 3D cameras, structured light transmitters and detectors, time-of-flight depth sensors, single-beam or sweeping laser rangefinders, 3D LiDAR sensors, and/or any other suitable type or form of optical sensor. An artificial-reality system may process data from one or more of these sensors to identify a location of a user, to map the real world, to provide a user with context about real-world surroundings, and/or to perform a variety of other functions.

The artificial-reality systems described herein may also include one or more input and/or output audio transducers. Output audio transducers may include voice coil speakers, ribbon speakers, electrostatic speakers, piezoelectric speakers, bone conduction transducers, cartilage conduction transducers, tragus-vibration transducers, and/or any other suitable type or form of audio transducer. Similarly, input audio transducers may include condenser microphones, dynamic microphones, ribbon microphones, and/or any other type or form of input transducer. In some embodiments, a single transducer may be used for both audio input and audio output.

In some embodiments, the artificial-reality systems described herein may also include tactile (i.e., haptic) feedback systems, which may be incorporated into headwear, gloves, body suits, handheld controllers, environmental devices (e.g., chairs, floormats, etc.), and/or any other type of device or system. Haptic feedback systems may provide various types of cutaneous feedback, including vibration, force, traction, texture, and/or temperature. Haptic feedback systems may also provide various types of kinesthetic feedback, such as motion and compliance. Haptic feedback may be implemented using motors, piezoelectric actuators, fluidic systems, and/or a variety of other types of feedback mechanisms. Haptic feedback systems may be implemented independent of other artificial-reality devices, within other artificial-reality devices, and/or in conjunction with other artificial-reality devices.

By providing haptic sensations, audible content, and/or visual content, artificial-reality systems may create an entire virtual experience or enhance a user's real-world experience in a variety of contexts and environments. For instance, artificial-reality systems may assist or extend a user's perception, memory, or cognition within a particular environment. Some systems may enhance a user's interactions with other people in the real world or may enable more immersive interactions with other people in a virtual world. Artificial-reality systems may also be used for educational purposes (e.g., for teaching or training in schools, hospitals, government organizations, military organizations, business enterprises, etc.), entertainment purposes (e.g., for playing video games, listening to music, watching video content, etc.), and/or for accessibility purposes (e.g., as hearing aids, visual aids, etc.). The embodiments disclosed herein may enable or enhance a user's artificial-reality experience in one or more of these contexts and environments and/or in other contexts and environments.

Figure 8A:
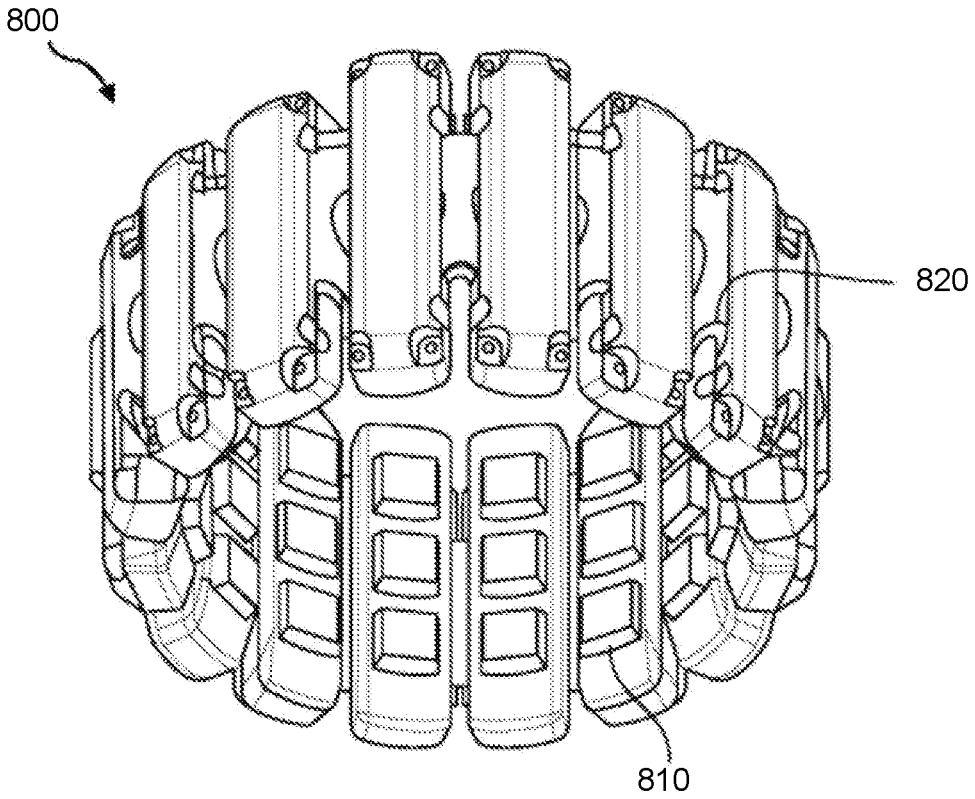
FIGS. 8A and 8B are illustrations of an exemplary human-machine interface configured to be worn around a user's lower arm or wrist.
Figure 8B:
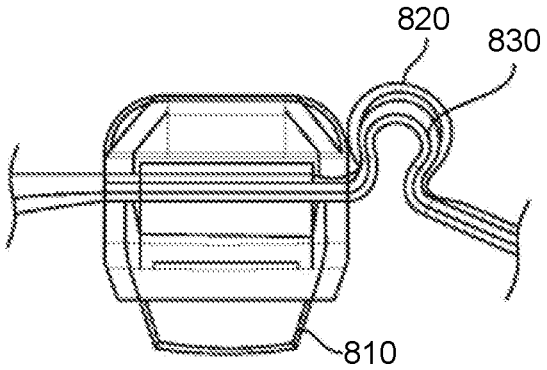

FIG. 8A illustrates an exemplary human-machine interface (also referred to herein as an EMG control interface) configured to be worn around a user's lower arm or wrist as a wearable system 800. In this example, wearable system 800 may include sixteen neuromuscular sensors 810 (e.g., EMG sensors) arranged circumferentially around an elastic band 820 with an interior surface 830 configured to contact a user's skin. However, any suitable number of neuromuscular sensors may be used. The number and arrangement of neuromuscular sensors may depend on the particular application for which the wearable device is used. For example, a wearable armband or wristband can be used to generate control information for controlling an augmented reality system, a robot, controlling a vehicle, scrolling through text, controlling a virtual avatar, or any other suitable control task. As shown, the sensors may be coupled together using flexible electronics incorporated into the wireless device. FIG. 8B illustrates a cross-sectional view through one of the sensors of the wearable device shown in FIG. 8A. In some embodiments, the output of one or more of the sensing components can be optionally processed using hardware signal processing circuitry (e.g., to perform amplification, filtering, and/or rectification). In other embodiments, at least some signal processing of the output of the sensing components can be performed in software. Thus, signal processing of signals sampled by the sensors can be performed in hardware, software, or by any suitable combination of hardware and software, as aspects of the technology described herein are not limited in this respect. A non-limiting example of a signal processing chain used to process recorded data from sensors 810 is discussed in more detail below with reference to FIGS. 9A and 9B.

Figure 9A:
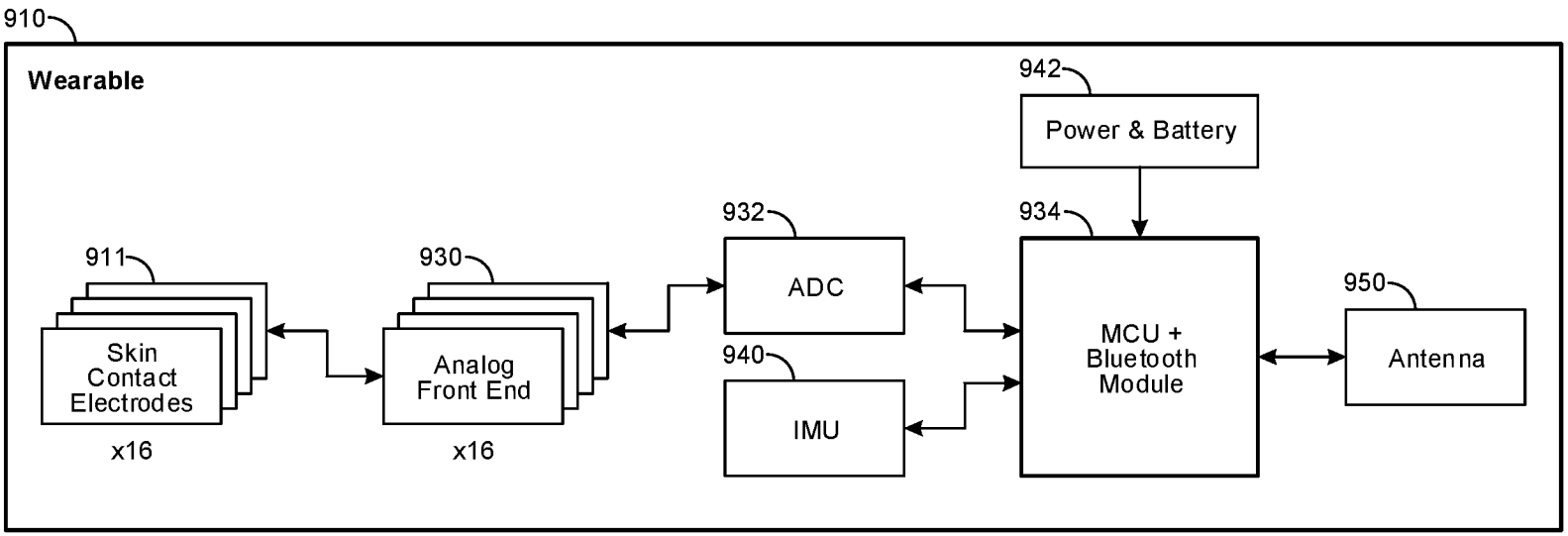
FIGS. 9A and 9B are illustrations of an exemplary schematic diagram with internal components of a wearable system.
Figure 9B:
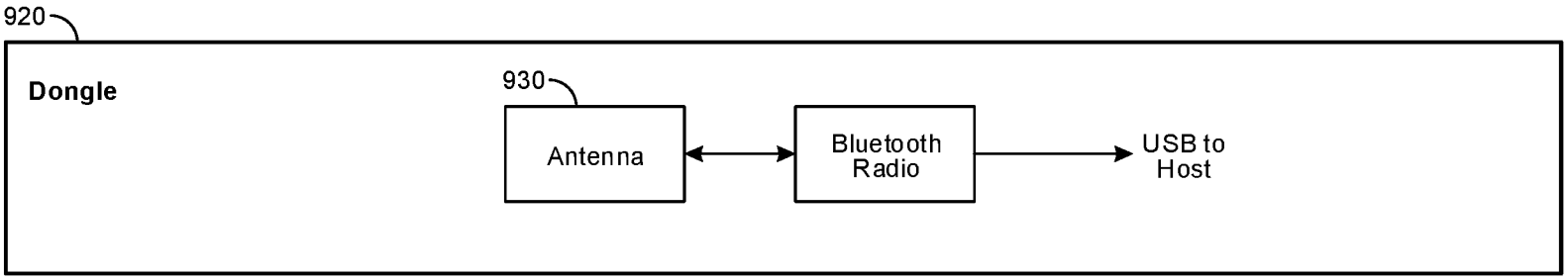

FIGS. 9A and 9B illustrate an exemplary schematic diagram with internal components of a wearable system with EMG sensors. As shown, the wearable system may include a wearable portion 910 (FIG. 9A) and a dongle portion 920 (FIG. 9B) in communication with the wearable portion 910 (e.g., via BLUETOOTH or another suitable wireless communication technology). As shown in FIG. 9A, the wearable portion 910 may include skin contact electrodes 911, examples of which are described in connection with FIGS. 8A and 8B. The output of the skin contact electrodes 911 may be provided to analog front end 930, which may be configured to perform analog processing (e.g., amplification, noise reduction, filtering, etc.) on the recorded signals. The processed analog signals may then be provided to analog-to-digital converter 932, which may convert the analog signals to digital signals that can be processed by one or more computer processors. An example of a computer processor that may be used in accordance with some embodiments is microcontroller (MCU) 934, illustrated in FIG. 9A. As shown, MCU 934 may also include inputs from other sensors (e.g., IMU sensor 940), and power and battery module 942. The output of the processing performed by MCU 934 may be provided to antenna 950 for transmission to dongle portion 920 shown in FIG. 9B.

Dongle portion 920 may include antenna 930, which may be configured to communicate with antenna 950 included as part of wearable portion 910. Communication between antennas 950 and 952 may occur using any suitable wireless technology and protocol, non-limiting examples of which include radiofrequency signaling and BLUETOOTH. As shown, the signals received by antenna 952 of dongle portion 920 may be provided to a host computer for further processing, display, and/or for effecting control of a particular physical or virtual object or objects.

Although the examples provided with reference to FIGS. 8A-8B and FIGS. 9A-9B are discussed in the context of interfaces with EMG sensors, the techniques described herein for reducing electromagnetic interference can also be implemented in wearable interfaces with other types of sensors including, but not limited to, mechanomyography (MMG) sensors, sonomyography (SMG) sensors, and electrical impedance tomography (EIT) sensors. The techniques described herein for reducing electromagnetic interference can also be implemented in wearable interfaces that communicate with computer hosts through wires and cables (e.g., USB cables, optical fiber cables, etc.).

As detailed above, the computing devices and systems described and/or illustrated herein broadly represent any type or form of computing device or system capable of executing computer-readable instructions, such as those contained within the modules described herein. In their most basic configuration, these computing device(s) may each include at least one memory device and at least one physical processor.

In some examples, the term "memory device" generally refers to any type or form of volatile or non-volatile storage device or medium capable of storing data and/or computer-readable instructions. In one example, a memory device may store, load, and/or maintain one or more of the modules described herein. Examples of memory devices include, without limitation, Random Access Memory (RAM), Read Only Memory (ROM), flash memory, Hard Disk Drives (HDDs), Solid-State Drives (SSDs), optical disk drives, caches, variations or combinations of one or more of the same, or any other suitable storage memory.

In some examples, the term "physical processor" generally refers to any type or form of hardware-implemented processing unit capable of interpreting and/or executing computer-readable instructions. In one example, a physical processor may access and/or modify one or more modules stored in the above-described memory device. Examples of physical processors include, without limitation, microprocessors, microcontrollers, Central Processing Units (CPUs), Field-Programmable Gate Arrays (FPGAs) that implement softcore processors, Application-Specific Integrated Circuits (ASICs), portions of one or more of the same, variations or combinations of one or more of the same, or any other suitable physical processor.

Although illustrated as separate elements, the modules described and/or illustrated herein may represent portions of a single module or application. In addition, in certain embodiments one or more of these modules may represent one or more software applications or programs that, when executed by a computing device, may cause the computing device to perform one or more tasks. For example, one or more of the modules described and/or illustrated herein may represent modules stored and configured to run on one or more of the computing devices or systems described and/or illustrated herein. One or more of these modules may also represent all or portions of one or more special-purpose computers configured to perform one or more tasks.

In addition, one or more of the modules described herein may transform data, physical devices, and/or representations of physical devices from one form to another. Additionally or alternatively, one or more of the modules recited herein may transform a processor, volatile memory, non-volatile memory, and/or any other portion of a physical computing device from one form to another by executing on the computing device, storing data on the computing device, and/or otherwise interacting with the computing device.

In some embodiments, the term "computer-readable medium" generally refers to any form of device, carrier, or medium capable of storing or carrying computer-readable instructions. Examples of computer-readable media include, without limitation, transmission-type media, such as carrier waves, and non-transitory-type media, such as magnetic-storage media (e.g., hard disk drives, tape drives, and floppy disks), optical-storage media (e.g., Compact Disks (CDs), Digital Video Disks (DVDs), and BLU-RAY disks), electronic-storage media (e.g., solid-state drives and flash media), and other distribution systems.

The process parameters and sequence of the steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

The preceding description has been provided to enable others skilled in the art to best utilize various aspects of the exemplary embodiments disclosed herein. This exemplary description is not intended to be exhaustive or to be limited to any precise form disclosed. Many modifications and variations are possible without departing from the spirit and scope of the present disclosure. The embodiments disclosed herein should be considered in all respects illustrative and not restrictive. Reference should be made to the appended claims and their equivalents in determining the scope of the present disclosure.

Unless otherwise noted, the terms "connected to" and "coupled to" (and their derivatives), as used in the specification and claims, are to be construed as permitting both direct and indirect (i.e., via other elements or components) connection. In addition, the terms "a" or "an," as used in the specification and claims, are to be construed as meaning "at least one of." Finally, for ease of use, the terms "including" and "having" (and their derivatives), as used in the specification and claims, are interchangeable with and have the same meaning as the word "comprising."

What is claimed is:

1. A system comprising:

a housing that includes a non-conducting substrate and a conductive enclosure that at least partially surrounds the non-conducting substrate;

an antenna disposed on the non-conducting substrate of the housing;

a direct electrical connection between the antenna and a first portion of the conductive enclosure; and an antenna feed electrically connected to a separate conductive portion on the non-conducting substrate, wherein the separate conductive portion on the non-conducting substrate is electrically connected to a second portion of the conductive enclosure.

2. The system of claim 1, further comprising a printed circuit board (PCB) that includes one or more electronic components of the antenna feed.

3. The system of claim 2, wherein the PCB is elevated off of the non-conducting substrate, such that a gap exists between the PCB and the non-conducting substrate.

4. The system of claim 2, further comprising one or more shorting pins that electrically connect the antenna disposed on the non-conducting substrate to the PCB.

5. The system of claim 4, wherein the one or more shorting pins are selected to tune the antenna to a specified frequency.

6. The system of claim 2, wherein the PCB including the one or more electronic components of the antenna feed is electrically connected to the conductive enclosure via a conductive element.

7. The system of claim 6, wherein the conductive element comprises a cable that electrically connects an RF system on the PCB to feed the conductive enclosure.

8. The system of claim 1, wherein the antenna is applied to the non-conducting substrate using laser direct structuring (LDS).

9. The system of claim 1, wherein the conductive enclosure comprises a metallic enclosure.

10. The system of claim 9, wherein the metallic enclosure at least partially surrounds a printed circuit board.

11. The system of claim 1, wherein the separate conductive portion of the non-conducting substrate is electrically isolated from other conductive portion on the non-conducting substrate.

12. A wearable electronic device comprising:

a housing that includes a non-conducting substrate and a conductive enclosure that at least partially surrounds the non-conducting substrate;

an antenna disposed on the non-conducting substrate of the housing;

a direct electrical connection between the antenna and a first portion of the conductive enclosure; and an antenna feed structure electrically connected to a separate conductive portion on the non-conducting substrate, wherein the separate conductive portion of the non-conducting substrate is electrically connected to a second portion of the conductive enclosure.

13. The wearable electronic device of claim 12, further comprising a PCB that includes one or more electronic components of the antenna feed structure.

14. The wearable electronic device of claim 13, wherein the PCB is elevated off of the non-conducting substrate, such that a gap exists between the PCB and the non-conducting substrate.

15. The wearable electronic device of claim 14, further comprising at least one camera positioned in the gap between the PCB and the non-conducting substrate.

16. The wearable electronic device of claim 13, wherein the antenna feed structure electrically links the PCB to the conductive enclosure through the separate conductive portion on the non-conducting substrate.

17. The wearable electronic device of claim 13, wherein the antenna feed structure directly electrically links the PCB to the conductive enclosure using a cable.

18. The wearable electronic device of claim 13, wherein the antenna is electrically connected to the conductive enclosure and is further grounded to the PCB.

19. The wearable electronic device of claim 12, wherein the antenna is configured to operate between 600 MHz-2600 MHz.

20. A method of manufacturing comprising:

providing a housing that includes a non-conducting substrate and a conductive enclosure that at least partially surrounds the non-conducting substrate;

disposing an antenna or conductive portions on the non-conducting substrate of the housing;

disposing a direct electrical connection between the antenna and a first portion of the conductive enclosure; and providing an antenna feed electrically connected to a separate conductive portion on the non-conducting substrate, wherein the separate portion of the non-conducting substrate is electrically connected to a second portion of the conductive enclosure.

* * * * *